US007224919B1

(12) United States Patent
Shemirani et al.

(10) Patent No.: US 7,224,919 B1
(45) Date of Patent: May 29, 2007

(54) SCHEDULING SYSTEM FOR PLACING TEST PATCHES OF VARIOUS TYPES IN A PRINTING APPARATUS

(75) Inventors: Bejan M. Shemirani, Penfield, NY (US); Jun W. Carney, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/516,838

(22) Filed: Sep. 7, 2006

(51) Int. Cl.
*G03G 15/00* (2006.01)

(52) U.S. Cl. ..... 399/72; 399/76; 399/77

(58) Field of Classification Search ..... 399/72, 399/15, 77, 31, 76
See application file for complete search history.

(56) References Cited

U.S. PATENT DOCUMENTS 5,504,568 A 4/1996 Saraswat et al.
6,167,217 A 12/2000 Kelsch et al.
6,385,408 B1 5/2002 Scheuer
2003/0118353 A1* 6/2003 Baller et al. ..... 399/8
2003/0128991 A1* 7/2003 Carling et al. ..... 399/8
2005/0271399 A1* 12/2005 Shigeta ..... 399/8

* cited by examiner

*Primary Examiner*—David M. Gray
*Assistant Examiner*—Geoffrey T Evans
(74) *Attorney, Agent, or Firm*—R. Hutter

(57) ABSTRACT

A digital printing apparatus comprises a rotatable image receptor defining a plurality of test zones along a circumference thereof. Test patches on the image receptor are requested for each of a plurality of types of test routines. A table is used for scheduling test routines requested by the control means, the table having as inputs a plurality of test zones for each a plurality of future rotations of the image receptor, and as outputs constraints relating to types of test routines for each test zone in a plurality of future rotations of the image receptor.

6 Claims, 4 Drawing Sheets

300

| IDZ \ ROTATION | 1 | 2 | 3 | 4 | 5 | 6 |
|---|---|---|---|---|---|---|
| IDZ1 | SUN ~~MARS~~ | ~~SUN~~ ~~MARS~~ | SUN ~~MARS~~ | ~~SUN~~ ~~MARS~~ | SUN ~~MARS~~ | EARTH ~~SUN~~ ~~MARS~~ |
| IDZ2 | MARS PLUTO | MARS ~~PLUTO~~ | MARS ~~PLUTO~~ | MARS PLUTO | EARTH ~~PLUTO~~ | EARTH ~~PLUTO~~ |
| IDZ3 | MARS PLUTO | MARS ~~PLUTO~~ | MARS ~~PLUTO~~ | MARS PLUTO | EARTH ~~PLUTO~~ | EARTH ~~PLUTO~~ |

FIG. 3

SCHEDULING SYSTEM FOR PLACING TEST PATCHES OF VARIOUS TYPES IN A PRINTING APPARATUS

CROSS-REFERENCE TO RELATED APPLICATION

The following patent applications are being filed simultaneously herewith: SCHEDULING SYSTEM FOR PLACING TEST PATCHES IN A PRINTING APPARATUS, U.S. patent application Ser. No., 11/517,163, Michael W. Elliot, et al; and SYSTEM FOR PREDICTING ERASURE OF TEST PATCHES IN A PRINTING APPARATUS, U.S. patent application Ser. No. 11/516,898, Michael W. Elliot, et al.

TECHNICAL FIELD

The present disclosure relates to digital printing systems, such as those using xerography.

BACKGROUND

Many printing technologies, such as xerography and ink-jet printing, exploit a rotatable imaging member on which an image is first created with marking material, such as liquid ink or powdered toner, and then transferred to a print sheet. When controlling such a printing apparatus, it is common to place on the imaging member at various times "test patches," meaning areas of marking material of predetermined desired properties such as optical density, and then measuring the actual properties of each test patch as part of an overall control process.

U.S. Pat. Nos. 6,167,217 and 6,385,408 disclose basic systems for scheduling the creation of test patches in a xerographic printer. U.S. Pat. No. 5,504,568 discloses a system in which images to be submitted to a printer a short time in the future are taken into consideration for purposes of scheduling two-sided printing.

SUMMARY

According to one embodiment, there is provided a digital printing apparatus, comprising a rotatable image receptor defining a plurality of test zones along a circumference thereof. Test patches on the image receptor are requested for each of a plurality of types of test routines and control means request test routines of predetermined types at various times. A table is used for scheduling test routines requested by the control means, the table having as inputs a plurality of test zones for each a plurality of future rotations of the image receptor, and as outputs constraints relating to types of test routines.

BRIEF DESCRIPTION OF THE DRAWINGS

FIG. 3 is an example of a look-up table that can arbitrate demands for test routines over a moving series of rotations of a photoreceptor.

DETAILED DESCRIPTION

Figure 1:
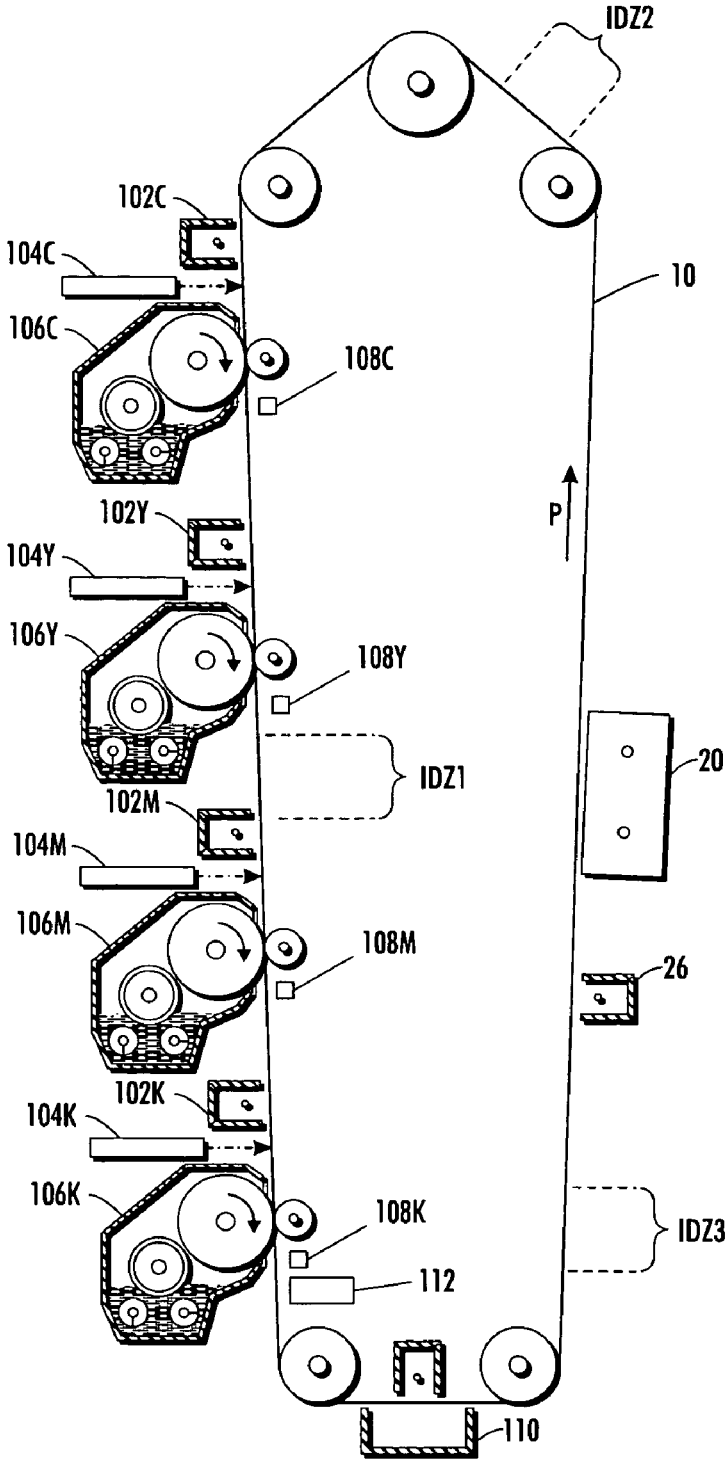
FIG. 1 PRIOR ART
FIG. 1 is a simplified elevational view of a color electrostatographic or xerographic printer.

FIG. 1 is a simplified elevational view of a color electrostatographic or xerographic printer, in this case using "image-on-image" technology to build up color images on a single photoreceptor, in a manner generally known in the art. There is provided a charge receptor in the form of a photoreceptor 10, which rotates along a process direction indicated as P. The main surface of the photoreceptor 10 passes through a series of charging stations 102C, 102M, 102Y, 102K, imaging stations 104C, 104M, 104Y, 104K (such as including raster output scanners or LED arrays) and development units 106C, 106M, 106Y, 106K, each development unit corresponding to a different primary color (cyan, magenta, yellow and black (K)). Each set of stations places a layer of marking material such as toner of one primary color on the main surface of photoreceptor 10, thus building up a full-color image to be printed. The built-up layers of marking material are then transferred to a print sheet at transfer station 110, as indicated. Any marking material remaining on the main surface of photoreceptor 10 following the transfer step is then removed at cleaning station 20.

In addition to the basic elements for printing images, the example color printer in FIG. 1 further includes a set of elements suitable for measuring properties, such as optical or electrostatic properties, of test patches of predetermined intended properties placed on the photoreceptor 10 at various times. In the FIG. 1 example (although a specific system will vary depending on the overall architecture of the printer) there are provided immediately downstream of each development unit 106C, 106M, 106Y, 106K, an electrostatic voltmeter or ESV, here indicated as 108C, 108M, 108Y, 108K. Further, there is provided an electronic toner-area coverage sensor (ETAC) 112 between the development units and the transfer station 110. The ETAC is a type of optical sensor that measures the optical density of a test patch placed on the photoreceptor; various types of optical sensor are known and can be used in various printing contexts.

The printer shown in FIG. 1 includes a multi-pitch photoreceptor 10; that is, the photoreceptor is long enough in the process direction to accept multiple page-size images with each rotation. The spaces between the image areas, each known as an inter-document zone (IDZ), or more broadly "test zone," are the typical locations for test patches, particularly for test routine carried out during printing of images. Three IDZ's, shown in FIG. 1 as IDZ1, IDZ2, and IDZ3, move with the rotating photoreceptor 10.

Figure 2:
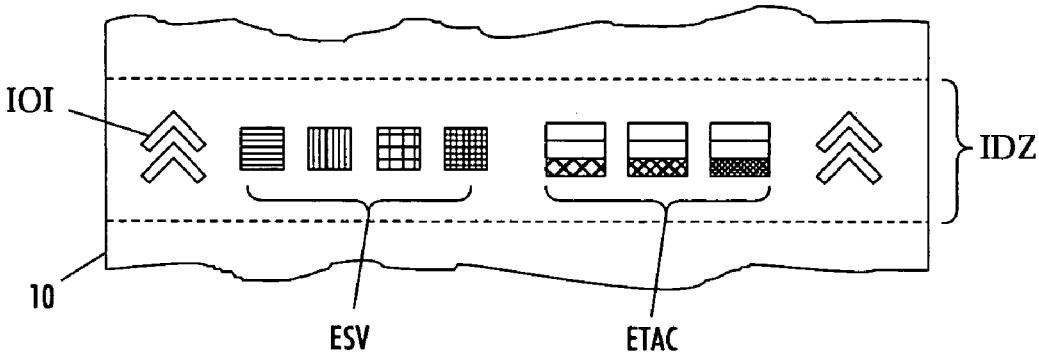
FIG. 2 PRIOR ART
FIG. 2 is a plan view of a typical arrangement of test patches as would be placed on a portion of a photoreceptor.

FIG. 2 is a plan view of a typical arrangement of test patches as would be placed on a given IDZ of a photoreceptor such as 10, as they would appear immediately downstream of the development units 106C, 106M, 106Y, 106K. These test patches are placed with marking material of various colors at various times during the operation (printing and/or start-up or diagnostic phases) of the printer. In the FIG. 2 example, the patches indicated as M, C, Y, K are single-primary color patches that would be aligned with corresponding ESV's 108C, 108M, 108Y, 108K (each patch would be read right after it was created by the development unit). The patches indicated as ETAC are disposed to be readable by one or more ETAC's 112 as shown in FIG. 1: as is generally known in the art, each patch may have a plurality of distinct regions, such as of different intended densities, that are read over time as the large patch passes over an ETAC 112. Also included among test patches are shapes such as the "image-on-image" registration marks, such as the chevrons indicated as 101, and which can be read in various known ways.

In a large production-volume digital printer, a number of what can be called "test routines," each with a specific purpose, will be desired or required at various times, during printing and/or start-up or diagnostic phases. A test routine may be defined as an instance in which a test patch of some kind is placed on the photoreceptor and then measured in some way. Some test routines must run at regular intervals, such as with every, or every other, rotation of photoreceptor 10; other routines are invoked on an ad-hoc basis, such as in response to long print runs, changes in ambient conditions, or to conditions detected as a result of regular test routines. Each test routine requires its own type of test patch, which may be inconsistent with a test patch required for another test routine: for example, one test routine may require a pure magenta patch, while another requires a magenta plus yellow test patch in the same area of the photoreceptor. Also, many types of test patches are of such density that multiple passes of the patch through the cleaning station 20, that is multiple rotations of the photoreceptor 10, are required to erase the test patch so that the underlying area of the photoreceptor 10 can accept a new test patch. These are among the various constraints placed on the ability to perform test routines over time.

The following disclosure relates to how patches for test routines can be scheduled in IDZ's for both ongoing regular test routines and ad-hoc test routines that may be desired in the course of printing images.

FIG. 3 is an example of a look-up table, indicated as 300, that can arbitrate demands for test routines in IDZ's over a moving series of rotations of a photoreceptor 10. The two types of inputs to the look-up table are the identity of each of (in this case, three) a number of IDZ's (test zones) available in a single rotation of photoreceptor 10; and, a schedule for the next six rotations of photoreceptor 10 at a given scheduling time. The outputs of the table are representations of the availability of the IDZ in a give future rotation, for different types of test routine.

Further to the description of table 300, there are names representing each of five test routines that may be desired to be performed during operation: sun, moon, earth, Mars, and Pluto. When a routine name is crossed out in the table, this means that, typically for some reason inherent to the design of the overall system and the requirement of the particular test routine, the named test routine cannot be performed in the indicated IDZ of the indicated rotation.

A typical set of constraints, which is reflected in the table 300, is as follows:

Requirements for algorithm Sun:

- The Sun algorithm is required to print a patch in Zone_1 every other belt rotation.
- Sun is never allowed to print patches in Zone_1 in consecutive rotations.
- Sun's patches conflict with all the other algorithm's patches and therefore no other algorithm can appear in a zone with Sun.

To achieve Sun's first and second requirement, Rotation_1/Zone_1 contains Sun while Rotation_2,/Zone_1 contains Sun (crossed out), alternating for the six rotations. The third requirement is achieved by not allowing any other algorithms to be fixed in the zones that contain Sun.

Requirements for algorithm Pluto:

- Pluto patches are required to be scheduled in 2 consecutive zones in the same rotation.
- Pluto patches cannot be printed in consecutive rotations and there can be no more than two rotations consecutively without Pluto patches.

To achieve Pluto's requirements, patches are reserved for Pluto in zones 2 and 3 for rotations 1 and 4. Pluto patches must be excluded for the two rotations in between. This will ensure that Pluto patches are always printed every three belt rotations. Notice that Pluto patches and Mars patches do not conflict with one another and can be reserved for the same zone. Pluto is excluded from rotations 5 and 6 to ensure they are not printed in consecutive rotations in the case where Earth is disabled by the customer.

Requirements for algorithm Mars:

- Mars is required to print a set of patches in two consecutive rotations.
- Mars can never use zone 1.

Mars must be listed as fixed otherwise the control system would restrict the use of zones 2 and 3 in rotations 1 and 4 to Pluto. By specifying both as being reserved the control system now has all the information needed to meet the requirements of both Mars and Pluto. Mars is restricted in zone 1 for all rotations.

Requirements for algorithm Earth:

- Earth schedules patches one rotation at a time. The two patch sets are unique and one of them uses zones 1, 2, and 3 while the other uses zones 2 and 3 only.
- Earth patches conflict with all other patches.

Earth requirements force rotations 5 and 6 to be added to the table and dedicated to Earth. If Earth is disabled by a customer then Mars could use zones 2 and 3 of rotations 5 and 6.

Requirements for algorithm Moon:

- Moon must schedule patches as frequently as possible but not prevent other algorithms from running.

Moon has no fixed schedule or exclusions and therefore does not appear in the table. If all algorithms are enabled, Moon patches will be restricted to zone 1 for rotations 2 and 4 as there are no algorithms reserved for these zones. Conversely, Moon patches could be scheduled in Rotation_2/Zone_2, for example, if Mars were disabled.

As can be seen, the various constraints described in detail above are summarized in the table of FIG. 3. As test routines of various types are required for various purposes, table 3 acts as a "clearinghouse" so that the different types of test routines are scheduled in a way that does not conflict with other test routines, particularly with regard to the competition for space along the circumference of photoreceptor 10.

Figure 4:
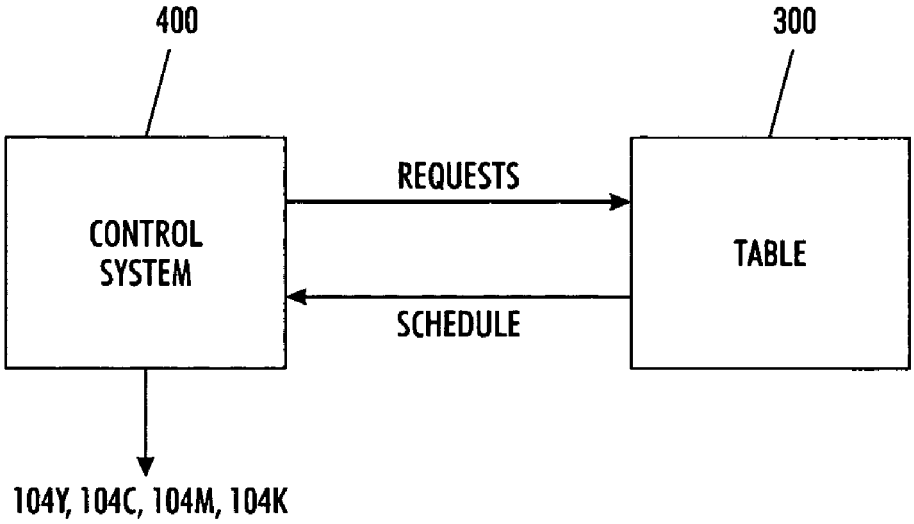
FIG. 4 is a diagram showing how the table of FIG. 3 interacts with a larger control system of a digital printer.

FIG. 4 is a diagram showing how the table 300 of FIG. 3 interacts with a larger control system of a digital printer. The basic control system 400 governing all of the operations of the printer (and which could be embodied within the printer, or have aspects embodied in separate general-purpose computers associated with the printer, such as used by a human operator) at various times requests test routines of predetermined types. As mentioned above, some test routines must run at regular intervals, such as with every, or every other, rotation of photoreceptor 10; other routines are invoked on an ad-hoc basis, such as in response to long print runs, changes in ambient conditions, conditions detected as a result of regular test routines, or simply as desired by a human operator.

When a test routine of a certain type is in effect requested by control system 400, the request is first sent through table 300. In practice, table 300 finds the first available opportunity within its time-window of future test zones and rotations of photoreceptor 10 suitable for the requested type of test routine, that is, the first opportunity that is not inconsistent with the constraints within table 300. The table 300 or its attendant software then in effect sends back to the larger control system 400 a time-slot in which the control system 400 can perform the requested test routine within the future time-window. Once the table 300 returns with a time opportunity for the requested test routine, the control system 400 operates the printer hardware, particularly lasers 104C, 104M, 104Y, 104K, to create the necessary test patches.

The table 300 can be generated from an XML file, which enables easy access by a programmer when changes in constraints are desired. The table 300 can be changed by changing data in the XML file to reflect the new requirements and no code changes are necessary.

While the present disclosure is directed to a xerographic printing apparatus, the teachings and claims herein can be readily applied to any rotatable imaging member such as an intermediate belt or drum as used in xerography, iconography, production ink-jet, or offset printing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A digital printing apparatus, comprising:

a rotatable image receptor defining a plurality of test zones along a circumference thereof;

means for placing test patches on the image receptor as requested for each of a plurality of types of test routines, including a test routine of a first type and a test routine of a second type;

control means for requesting test routines of predetermined types at various times;

a table for scheduling test routines requested by the control means, the table having as inputs a plurality of test zones for each a plurality of future rotations of the image receptor, and as outputs constraints relating to types of test routines, the constraints including a constraint that a test patch associated with a test routine of a first type cannot occur in a predetermined relation to a test routine of a second type.

2. The apparatus of claim 1, further comprising means for rejecting a requested test routine if the test routine is inconsistent with the table.

3. The apparatus of claim 1, further comprising means for rescheduling the test routine of the second type if the test routine of the second type is rejected by the table.

4. The apparatus of claim 1, the constraints including a constraint that a test patch associated with a test routine of a first type cannot occur in a predetermined test zone in a predetermined future rotation of the image receptor.

5. The apparatus of claim 1, the table including a fixed schedule of mandated periodic test routines.

6. The apparatus of claim 1, the table being associated with an XML file.

* * * * *